United States Patent [19]

Rosenberg

[11] 4,255,908

[45] Mar. 17, 1981

[54] WINDOW INSULATING DEVICE

[76] Inventor: David Rosenberg, 155 W. 68th St., New York, N.Y. 10023

[21] Appl. No.: 36,037

[22] Filed: May 4, 1979

[51] Int. Cl.[3] ..... E04B 1/34

[52] U.S. Cl. ..... 52/2; 52/202; 49/477

[58] Field of Search ..... 52/2, 202, 203, 171; 160/90; 49/477

[56] References Cited

U.S. PATENT DOCUMENTS

| | | | |
|---|---|---|---|
| 3,391,503 | 7/1968 | O'Neal | 52/2 |
| 3,918,512 | 11/1975 | Kuneman | 160/90 |
| 4,040,210 | 8/1977 | Land | 52/2 |
| 4,098,035 | 7/1978 | Bessler | 52/202 X |
| 4,155,208 | 5/1979 | Shanaburger | 52/2 X |

*Primary Examiner*—Price C. Faw, Jr.
*Assistant Examiner*—Carl D. Friedman
*Attorney, Agent, or Firm*—Lewis H. Eslinger

[57] ABSTRACT

A heat insulation panel is adapted to be mounted in a window frame and includes a pair of spaced substantially flat face sheets connected by a plurality of connector strips extending therebetween. The peripheral edge of the panel is sealed by a gusset strip in air tight relation. The gusset strip has a firmer hand than the face sheets and is approximately 25% heavier in gauge so that upon inflation the edge of the panel remains substantially flat in order to form a broad substantially air tight seal with the periphery of a window frame in which the panel is inserted. The gusset edge also can cooperate with the edge of an adjacent panel to form a substantially air tight seal therebetween.

9 Claims, 5 Drawing Figures

FIG. 2
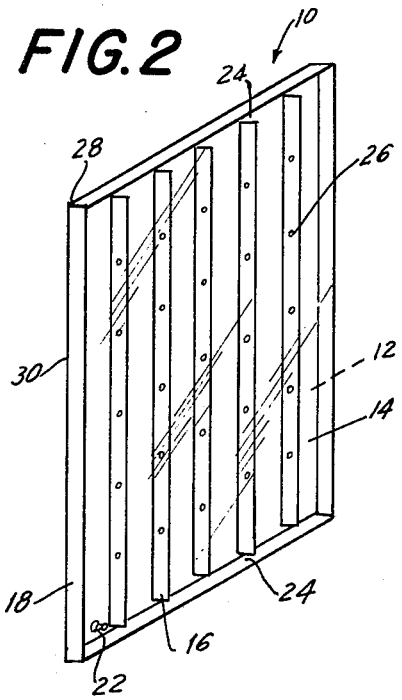
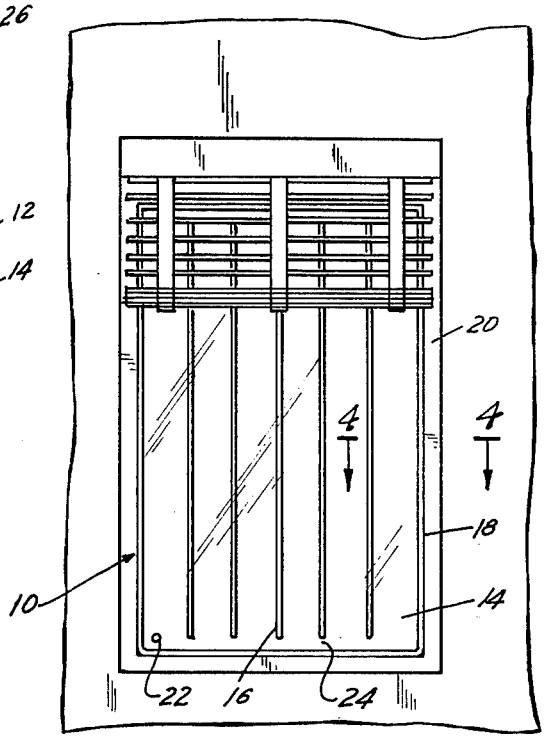
FIG. 3
FIG. 4
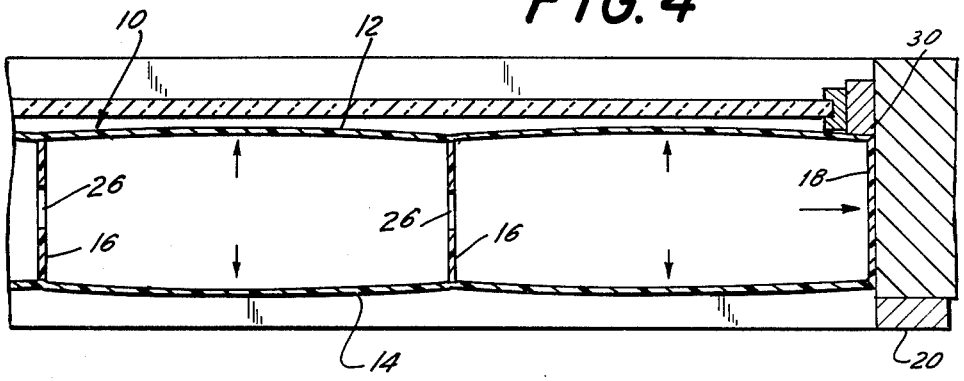

WINDOW INSULATING DEVICE

The present invention relates to a heat insulating panel, and more particularly to an inflatable panel adapted to be used in a storm window in pre-existing window frames.

It is well known that windows contribute to heat losses in a house to a very substantial extent. For example, a single pane of ordinary window glass has an R-value of about 0.9 whereas an uninsulated wood frame wall with a wood siding has an R-value of about 5. In other words, a square foot of glass will conduct heat five times as fast as a square foot of uninsulated wood frame wall. If 15% of the total wall area of a house is taken up by windows, then the house will lose as much heat through the windows via conduction as it loses through the walls. Of course, this loss will be even greater where the walls of the house are themselves insulated.

Windows contribute to heat loss in two ways, through conduction, or flow of heat through the glass itself, and through air leakage. It is known that even a closed window will allow some air to escape where the sashes fit into the frame or come together. This is particularly true in colder areas of the country where the cold outside air causes the frame to contract, increasing the size of the spaces between the window and sash elements.

It has been found that adding storm windows to a house will cut energy consumption by about 25% a year. This can be done by adding a permanent exterior storm window to the window frame, or by using removable single pane panels mounted on the exterior of the house. Such rigid storm window structures are however relatively expensive and difficult to install and remove.

Thermal resistance produced by glass, for example in thermal windows where multiple thicknesses of glass are used, is primarily found in the convection air interfaces along the surface of the glass layers, and not actually by the thickness of the glass itself. Thus, the more convection air interfaces provided, the greater will be the thermal resistance value of the storm window; and obviously, triple pane windows have a greater R-value than double pane windows. On the other hand, the thickness of the panes themselves has little effect on the R-value.

In the continuing search for improved insulation systems for homes, in order to aid in the conservation of energy, a variety of different types of storm window constructions or insulation panels have been previously proposed. One arrangement of interest is disclosed in U.S. Pat. No. 4,040,210 to Land, wherein a relatively rigid panel construction is provided having an inflatable peripheral tube that enables the panel to be mounted within a window frame in order to define an air space and improve insulation at the window. In an alternative embodiment, Land suggests the use of a plurality of connected tubes to form a window panel construction.

In accordance with an aspect of the present invention an improved inflatable heat insulation panel for use in a window frame is provided which will produce increased thermal resistance at the window because of the provision of additional thermal air interfaces. The panel will assure a relatively air tight seal about the periphery of the window to prevent heat losses as a result of air leakage through the window frame and sash. More specifically, the panel includes a pair of generally complementary rectangularly shaped spaced flat face sheets which are formed of an inflatable vinyl plastic material. These sheets are positioned in spaced parallel relation to each other and maintained in such relation by a plurality of parallely extending connector and reinforcement strips that are positioned therebetween. These connector strips, or I-beams, extend generally perpendicular to the face sheets and are formed of an inflatable vinyl plastic material of slightly greater gauge than that of the face sheets, so that upon inflation of the panel the connector strips keep the face sheets in a relatively planar configuration and limit the bulging of the face sheets as a result of air pressure acting thereon.

A gusset strip extends between the face sheets along the peripheries thereof and is sealed thereto in an air tight relation to define with the face sheets the air tight panel. The gusset has a firmer hand than the face sheets and connector strips and a gauge which is greater than the gauge of both the face sheet and the connector strips and which is approximately 25% greater than the gauge of the face sheets. Because of the firmer hand and the increased gauge of the gusset strip, when the panel is inflated the gusset will not bulge to any material extent, but will rather provide a relatively flat straight peripheral edge to the panel. This is extremely important since the broad flat edge provides a broad seal against the frame of the window, or against the abutting gusset edge of an adjacent panel, in order to prevent air leakage and attendant heat loss.

The selection of the relative hands of the plastic material and their relative gauges, is highly important in the construction of the present invention. It will be understood that the term "hand" is a term of art in the vinyl plastic field and refers to the relative flexibility or stiffness of the material. If the gusset strip is too stiff relative to the face sheet material the seal formed therebetween will not hold under pressure, but rather will break or tear, destroying the device. There must be a proper relationship between the materials used to form the panel in order to achieve the desired result of a flat peripheral edge, while at the same time maintaining an air tight seal therebetween.

The above, and other objects, features and advantages of this invention will be apparent in the following detailed description of an illustrative embodiment thereof, which is to be read in connection with the accompanying drawing, wherein:

FIG. 2 is a perspective view of the panel shown in FIG. 1;

FIG. 3 is a plan view showing the panel of FIG. 2 installed in a window;

FIG. 4 is a sectional view taken along line 4—4 of FIG. 3; and

Figure 1:
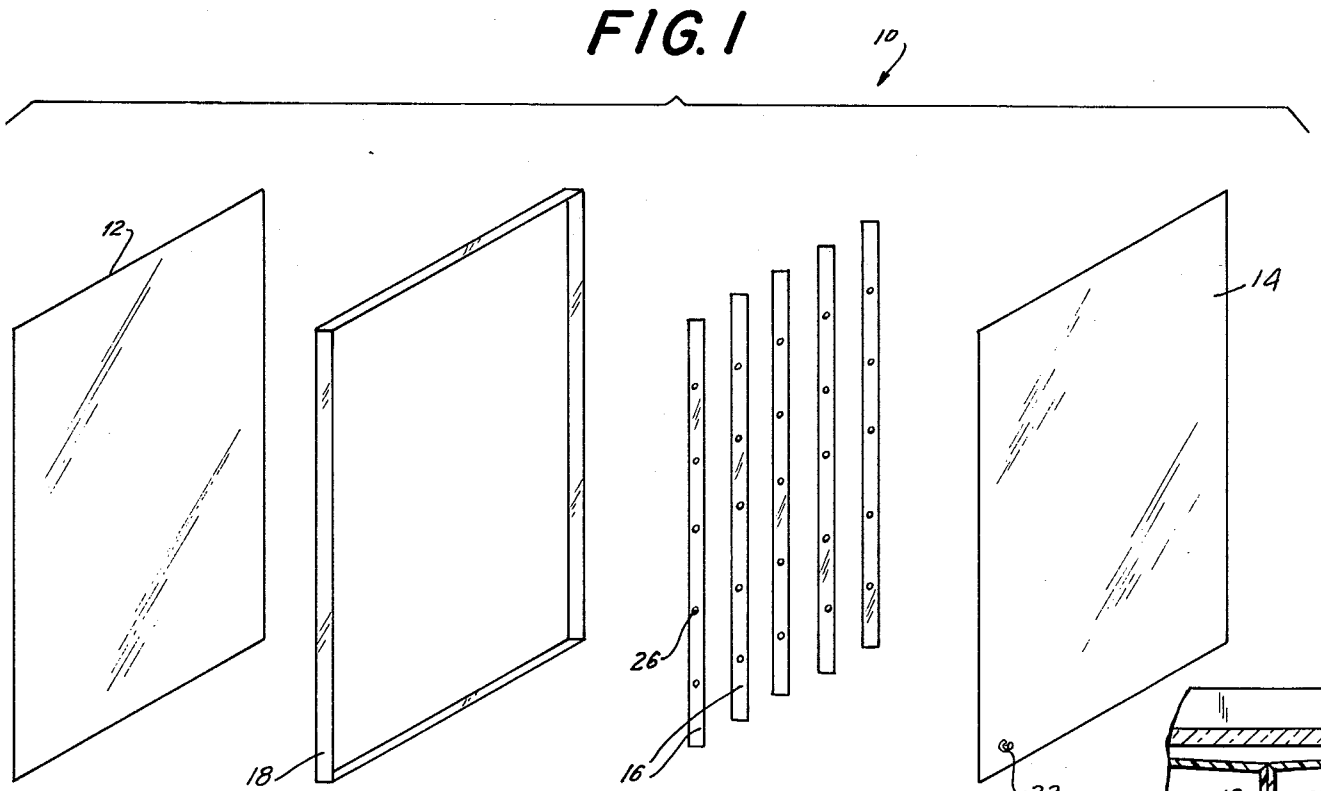
FIG. 1 is an exploded perspective view of a heat insulating panel constructed in accordance with the present invention.

Referring now to the drawing in detail, and initially to FIG. 1 thereof, it will be seen that a panel 10 consists of a pair of face sheets 12, 14, which respectively define the back and front of the heat insulating panel. A plurality of connector strips or I-beams 16 extend between and perpendicularly to the face sheets 12, 14, while a preferably one-piece peripheral gusset strip 18 is located about the periphery of the face sheets 12, 14, to form the completed panel.

In the illustrative embodiment of the present invention face sheets 12, 14 are generally rectangular in plan and are dimensioned to fit within the internal periphery of a conventional window frame 20, as shown in FIG. 3. Preferably the dimensions of the face sheets 12, 14 are slightly greater than the interior periphery of the window frame so that inflation of the panel will hold it rigidly in place within the window frame.

As seen in FIG. 2 face sheets 12, connector strips or I-beams 16 and gusset 18 are joined together to form the essentially rectangular one-piece panel 10, with an air inflation valve 22 mounted in one corner of the panel, in any convenient manner.

Panel 10 is constructed by first connecting the I-beams 16 between the face sheets 12, 14. This is done by electronic sealing operations which are well known in the art. These I-beam strips have, in accordance with the present invention, a width dimension which is between ¾" and 3", in order to maintain the face sheets 12, 14 at uniform parallel spacing to each other. It has been found that most window frames have a width of about 4", and thus it is believed that by making the width of the I-beams about 3", the panel of the invention will fit firmly within most window frames, so that the device can be easily and economically mass produced in a small number of uniform sizes.

I-beams 16 have free ends 24 which are spaced from the adjacent side of gusset 18 so that the channels defined by the I-beams are all in air communication with each other, and all areas of the panel are in communication. As is known, with this type of construction, there are increased stresses located at the ends of the I-beams when the panel is inflated. In order to reduce these stresses, and insure the integrity of the device, and in particular the seals between the I-beams and the face sheets 12, 14 a plurality of evenly spaced holes 26 are formed along the length of the I-beams to provide air passages therebetween. This allows air flow between the channels along the entire length of the I-beams and reduces the stresses on the seals between the I-beams and the face sheets at the ends of the I-beams.

The gusset 18 is secured to the peripheral edges of the panels 12, 14 by electronic sealing in any known manner. Preferably the panels are formed so that the corners 28 thereof are rounded, and the seal 30 between the edge of the gusset and the panel sheets have a teardrop end, to provide a smooth feel and appearance. This type of seal is well known in the art.

As thus far described, the structure of the panel of the present invention is known. The use of I-beams in inflatable structures, and gusset strips between face sheets have been used in the past. For example, gussets have been used in inflatable furniture construction, and I-beam elements have been used in air inflatable beach rafts. However, in each instance the various elements of the structure were formed of the same type of material and there has been no suggestion that such structures could be used to form heat insulating panels adapted to be mounted in window structures.

In accordance with the present invention the window panel structure is formed of selected materials particularly adapted to cooperate with each other for the particular function to provide the ability in the panel to act as a heat insulating device in a window.

More specifically, face sheets 12, 14 are formed of a pinhole free inflatable vinyl plastic non-tacky compound. It will be understood that the term "inflatable vinyl plastic compound" is known in the art as a particular type of plastic adapted to be used in inflatable structures. One typical type of inflatable vinyl plastic compound uses 30 to 33 parts per hundred of a known vinyl resin plasticizer such as DOP (DiOctylpthalate). In accordance with the invention these face sheets are of between 9 and 15 gauge vinyl sheets. The I-beams connecting the face sheets are formed of the same type of plastic material, having slightly less plasticizer and a slightly greater gauge than that of the face sheets so that the I-beams have greater strength than the face sheets, and somewhat less flexibility. This enables the I-beams to reinforce the face sheets, as seen in FIG. 4, and resist outward bulging of the face sheets against air pressure when the panel is pressurized. Preferably the I-beams are spaced no more than 4 inches apart, in order to maintain the face sheets as flat as possible. As a result the face sheets are maintained in a relatively flat configuration after inflation, with a minimum of bulging. Since the plastic used to form the face sheets is preferably a glass clear plastic, maintaining the panels flat is important, to permit good visibility through the heat insulation panel.

In order to insure a good air tight seal along the periphery of the panel and avoid heat losses due to air leakage, gusset 18 is formed of a heavier gauge material than either the face sheet or the I-beams, i.e. it is formed of sheet material having a gauge of between 12 to 18. In particular the gusset is formed of a heavy gauge inflatable vinyl plastic compound similar to that used for the face sheets, but having a gauge which is approximately 25% greater than the gauge of the face sheets, while the plasticizer contained is decreased by about 25% as compared to the amount used in the face sheets. As a result, there is little or no stretch in the gusset when the panel is inflated, so that the gusset remains relatively flat along the entire periphery of the panel. Thus, when the panel is inserted in window frame 20, the gusset forms a broad relatively air tight seal between the panel and the window frame, resisting heat losses due to leakage. The selection of the relative gauges and hand of the plastic materials of the various components of the panel is important since if the gusset is not of the proper thickness or is too hard, as compared to the face sheets, then the electronic seals formed along the edges 30 thereof will tear under pressure, split apart, and destroy the panel. The heavier gauge plastic of the gusset has a further advantage in that there is the area of the panel which will be subject to potential abrasion in the window frame or against other units. The heavier gauge gives the edge of the panel, and thus the panel itself, greater life.

In addition, it is preferred that the plastic materials include a known ultraviolet filter material to protect the plastic against actinic degradation.

Figure 5:
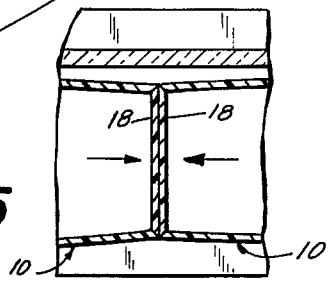
FIG. 5 is a sectional view, similar to FIG. 4, showing the abutment of the ends of two adjacent panels constructed in accordance with the present invention.

In large window frames a plurality of panel members 10 constructed in accordance with the present invention can be used in a side by side relation, as shown in FIG. 5. The provision of the heavier gauge gusset of the panel is important in this use of the invention since the flat panels can easily abut and engage one another and form a relatively broad seal therebetween again to control air leakage and form a uniform continuous insulating panel. If the gussets 18 were formed of the same material as the face panels, they would bulge into a tubular form so that contact therebetween would be restricted to a relatively narrow band, or the bulging would be such as to make it impossible for the two panels to remain butted against one another. This is particularly true where tubular panels of generally circular cross-section might be used, or where the inflation is such as to cause the panels to bulge to a generally circular arcuate edge.

The construction of the present invention has numerous advantages in addition to producing the desired heat insulation in a home by increasing thermal resistance at the window area. In particular, the structure is very easy to mount in a window, and is very inexpensive to manufacture. Indeed, it is believed that the cost of a window panel constructed in accordance with the present invention will be less than 1/10 of the cost of the conventional storm windows presently available to the public. The inflatable panel is durable in construction and is easily deflated and folded for storage. It is lightweight, and can be be easily inserted and removed from windows by children or by the elderly, without the use of any tools or talent. The panel may be inflated prior to insertion in the window, or it may be partially inflated, then inserted in the window, and then the inflation completed in order to hold the panel tightly against the interior of the window frame.

The panel may be inserted so that its rear face is flush against the outside window glass, or so that it is spaced slightly from the window glass to produce an additional dead air space, as seen in FIG. 4. With this arrangement, it is believed that the heat insulating panel will be more efficient in conserving energy than conventional double or triple glazed windows, and this will occur at a fraction of the cost of such windows.

In addition to its heat insulating ability, it has been found that the use of the panel of the present invention will be most effective in minimizing outside sounds from entering into the home. This is particularly important in city dwellings. Indeed, this acoustic deadening produced by the device of the present invention will be substantially greater than that produced by storm windows.

A still further advantage of the present invention is that these panels can be taken with a person if he or she moves from one home to another. They are a one-time investment which need not be left behind as a person moves from place to place. Because they are inflatable they can fit a range of differently sized windows, which is not the case with rigid conventionally permanently installed storm window structures.

In addition, the panel construction of the invention can be formed as a decorative item, by making the plastic face sheets of an opaque color to eliminate light entering a room. Likewise, these plastic sheets can be printed in decorator designs of an infinite variety, in order to act as decorative items in a room, as well as providing the desired heat and acoustic insulation. And, where glass clear vinyl plastic is used for the face sheets, it is possible to form the connector strips of a variety of different colors, to give the appearance of vertical blinds. In any case, because the heat insulating panel is mounted within the window frame, it would be located behind any venetian blinds or curtains mounted on the adjacent wall of the room, so that it can be hidden from view, if desired, without obstructing the function or operation of the blinds or the drapery.

Although an illustrative embodiment of the present invention has been described herein with reference to the accompanying drawings, it is to be understood that the invention is not limited to that precise embodiment, and that various changes and modifications may be effected therein by one skilled in the art without departing from the scope or spirit of this invention.

I claim:

1. A heat insulation device adapted to be mounted in a window frame comprising a pair of spaced substantially planar parallel extending face sheets of plastic material, a plurality of plastic connector strips extending perpendicular to and extending between said face sheets, said connector strips contacting and being secured only to said face strips along their opposed edges; and a gusset strip extending between said face sheets along the peripheries thereof and being sealed thereto in an air tight relation, said gusset strip having a firmer hand than said face sheets and being approximately 25% heavier in gauge; and valve means for inflating said device, whereby said connector strips maintain the face sheets in substantially planar configuration upon inflation; said connector strips having free ends which are spaced from the adjacent gusset strips whereby all parts of the device are in air communication with each other and said gusset strip defines a substantially flat planar edge throughout the periphery of the device to form a substantially air tight seal with the window frame or the gusset of an adjacent heat device.

2. A heat insulating device as defined in claim 1 wherein said face sheets are formed of 9 to 15 gauge vinyl inflatable plastic having 30 to 33 pts per 100 of plasticizer therein and said gusset strip is formed of 12 to 18 gauge vinyl inflatable plastic with about 25% less plasticizer therein than said face sheets whereby said gusset does not stretch materially upon inflation of said device.

3. A device as defined in claim 2 wherein said connector strips are formed of a vinyl inflatable plastic having a gauge which is greater than the face sheets but less than that of the gusset strip.

4. The device as defined in claim 1 wherein said connector strips have a width of between $\frac{3}{4}''$ and 3".

5. The device as defined in claim 4 wherein said connector strips have spaced holes formed therein providing air passages thereby to reduce stresses at the ends of the strips.

6. The device as defined in any one of claims 1, 2, 3, 4, or 5 wherein said face sheets are formed of nontacky glass-clear inflatable vinyl plastic sheet material.

7. A heat insulation panel adapted to be mounted in a window frame comprising a pair of generally complementary spaced flat face sheets formed of an inflatable vinyl plastic material positioned in spaced parallel relation to each other, a plurality of parallel extending connectors and reinforcement strips positioned between and extending generally perpendicular to said face sheets, said connector and reinforcement strips being formed of an inflatable vinyl plastic material of slightly greater gauge than said face sheets and being sealed to said face sheets along their opposed edges; and a gusset strip extending between said face sheets along the peripheries thereof and being sealed thereto in air tight relation to define with said face sheet an air tight panel; said gusset having a firmer hand than said face sheets and connector strips and a gauge which is greater than the gauge of both the face sheets and connector strips and approximately 25% greater than the gauge of the face sheets; and valve means for inflating the panel, said face sheets being formed of 9 to 15 gauge vinyl inflatable plastic having 30 to 33 parts per 100 of plasticizer therein and said gusset strip being formed of 12 to 18 gauge vinyl inflatable plastic with about 25% less plasticizer therein than said face sheets whereby said connector strips maintain the face sheets in a substantially planar configuration upon inflation and restrain bulging of the face sheets therebetween, while the gusset strip defines flat planar edges on the panel to form a broad substantially air tight seal with the adjacent window frame.

8. A panel as defined in claim 7 wherein said face sheets are generally rectangular in plan whereby said gusset strip provides straight flat edges about the periphery of the panel when inflated and can butt against and form an air tight seal with the gusset strip of an adjacent panel.

9. A panel as defined in claim 8 wherein said connector strips extend parallel to two parallel sides of the gusset strip and have free ends spaced from the other two sides of the gusset strip; said connector strips having air passages formed therein along their length to reduce stress at the ends of the strips.

* * * * *